US008798307B2

(12) United States Patent
Enomoto

(10) Patent No.: US 8,798,307 B2
(45) Date of Patent: Aug. 5, 2014

(54) SPEAKER UNIT

(71) Applicant: Sony Corporation, Tokyo (JP)

(72) Inventor: Tsutomu Enomoto, Kanagawa (JP)

(73) Assignee: Sony Corporation (JP)

( * ) Notice: Subject to any disclaimer, the term of this patent is extended or adjusted under 35 U.S.C. 154(b) by 36 days.

(21) Appl. No.: 13/718,156

(22) Filed: Dec. 18, 2012

(65) Prior Publication Data

US 2013/0170677 A1 Jul. 4, 2013

(30) Foreign Application Priority Data

Dec. 28, 2011 (JP) ..... 2011-289032

(51) Int. Cl.
*H04R 9/06* (2006.01)
*H04R 9/02* (2006.01)
*H04R 19/02* (2006.01)

(52) U.S. Cl.
CPC .. *H04R 9/06* (2013.01); *H04R 9/02* (2013.01); *H04R 19/02* (2013.01); *H04R 2499/13* (2013.01)
USPC ..... 381/396; 381/389; 381/412

(58) Field of Classification Search
CPC ..... H04R 9/02; H04R 9/06; H04R 19/02; H04R 2499/13
USPC ..... 381/191, 396, 412, 413, 87, 332, 335, 381/345, 162, 386, 389, 390, 395; 181/198, 181/199
See application file for complete search history.

(56) References Cited

U.S. PATENT DOCUMENTS

| | | | | |
|---|---|---|---|---|
| 2006/0045300 | A1* | 3/2006 | Sterns | 381/345 |
| 2007/0025587 | A1* | 2/2007 | Hlibowicki | 381/412 |
| 2010/0142747 | A1* | 6/2010 | Kemmerer | 381/387 |
| 2012/0140977 | A1* | 6/2012 | Hiramoto | 381/412 |

FOREIGN PATENT DOCUMENTS

| | | | |
|---|---|---|---|
| JP | 7-095687 | B | 10/1995 |
| JP | 2008-099106 | A | 4/2008 |
| JP | 5-018198 | B2 | 9/2012 |

* cited by examiner

*Primary Examiner* — Tuan D Nguyen
(74) *Attorney, Agent, or Firm* — Lerner, David, Littenberg, Krumholz & Mentlik, LLP

(57) ABSTRACT

Disclosed herein is a speaker unit, including: a magnetic circuit having a magnet and a coil; a vibrating plate adapted to be vibrated by a drive force of the magnetic circuit; and a frame having a circuit mounting portion to which the magnetic circuit is mounted, an edge mounting portion to which an edge of the vibrating plate is mounted, and plural leg portions through which the circuit mounting portion and the edge mounting portion are coupled to each other and which are provided in spaced relation to one another in a circumferential direction, wherein irregularity portions are provided in the plural leg portions, respectively, and forms of the irregularity portions are made different from each other at least in two of the leg portions.

7 Claims, 11 Drawing Sheets

SPEAKER UNIT

BACKGROUND

The present disclosure relates to a speaker unit. More particularly, the present disclosure relates to a speaker unit in which irregularity portions having different forms are formed in plural leg portions of a frame at least in one-to-one correspondence to reduce resonance, thereby enhancing a sound quality without causing reduction of the strength of the frame.

Some speaker units are of a type in which a vibrating plate is vibrated by a driving force of a magnetic circuit having a magnet and a coil. In such a type of speaker unit, edges of the vibrating plates and the magnetic circuits are mounted to portions of the frame.

The frame includes a circuit mounting portion, an edge mounting portion, and plural leg portions. In this case, the magnetic circuit is mounted to the circuit mounting portion, and an edge of the vibrating plate is mounted to the edge mounting portion. Also, the circuit mounting portion and the edge mounting portion are coupled to each other through the plural leg portions which are provided in spaced relation to one another in a circumferential direction.

In the speaker unit as described above, the vibrating plate is vibrated, thereby outputting a sound. However, in the case where the frame is vibrated by a reaction following the vibration of the vibrating plate and also the plural leg portions are formed in the same size and the same shape, it is feared that a resonance sound is generated at a specific frequency to reduce the sound quality.

In order to cope with such a situation, some existing speaker units are constructed in such a way that the strengths of plural leg portions are made non-uniform, thereby preventing the reduction of the sound quality. This sort of speaker unit, for example, is described in Japanese Patent Laid-Open No. Hei 7-95687.

However, when the strengths of the plural leg portions are made non-uniform, there is the possibility that the strength as a whole of the frame is reduced. In particular, in a use application in which the speaker unit is used in an environment causing the vibration to be readily generated as with an on-vehicle speaker unit, there is the possibility that the strength is insufficient.

On the other hand, others are constructed in such a way that reinforcing ribs provided in leg portions of the frame, thereby increasing the strength. This sort of speaker unit, for example, is described in Japanese Utility Model Laid-Open No. Hei 5-18198.

However, in the speaker unit described in Japanese Utility Model Laid-Open No. Hei 5-18198, it is possible to increase the strength. However, since the leg portions are formed in the same shape and the same size, including the reinforcing ribs, it is feared that the resonance sound is generated at the specific frequency, thereby reducing the sound quality.

The present disclosure has been made in order to solve the problems described above, and it is therefore desirable to provide a speaker unit in which a sound quality can be enhanced without causing reduction of the strength of a frame.

In order to attain the desire described above, according to an embodiment of the present disclosure, there is provided a speaker unit including: a magnetic circuit having a magnet and a coil; a vibrating plate adapted to be vibrated by a drive force of the magnetic circuit; and a frame having a circuit mounting portion to which the magnetic circuit is mounted, an edge mounting portion to which an edge of the vibrating plate is mounted, and plural leg portions through which the circuit mounting portion and the edge mounting portion are coupled to each other and which are provided in spaced relation to one another in a circumferential direction, in which irregularity portions are provided in said plural leg portions, respectively, and forms of the irregularity portions are made different from each other at least in two of said leg portions.

Therefore, in the speaker unit described above, the resonance frequency is dispersed in the leg portions of the frame.

Secondly, preferably, in the speaker unit described above, of the forms of the irregularity portions, sizes may be made different from each other.

Of the forms of the irregularity portions, the sizes are made different from each other, whereby the degree of freedom for a design of the frame is increased.

Thirdly, preferably, in the speaker unit described above, of the forms of the irregularity portions, shapes may be made different from each other.

Of the forms of the irregularity portions, the shapes are made different from each other, whereby the degree of freedom for a design of the frame is increased.

Fourthly, preferably, in the speaker unit described above, of the forms of the irregularity portions, numbers may be made different from each other.

Of the forms of the irregularity portions, the numbers are made different from each other, whereby the degree of freedom for a design of the frame is increased.

Fifthly, preferably, in the speaker unit described above, the leg portions may be provided by four; of the four leg portions, each two leg portions may be provided so as to be located in opposing corners, respectively; the numbers of irregularity portions formed in each two leg portions located in the opposing corners, respectively, may be made equal to each other; and the numbers of irregularity portions formed in each two leg portions adjacent to each other in a circumferential direction may be made different from each other.

Of the four leg portions, of the four leg portions, each two leg portions are provided so as to be located in opposing corners, respectively; the numbers of irregularity portions formed in each two leg portions located in the opposing corners, respectively, are made equal to each other; and the numbers of irregularity portions formed in each two leg portions adjacent to each other in a circumferential direction are different from each other, whereby with the simple construction, the resonance frequency in the leg portions of the frame is dispersed.

Sixthly, preferably, in the speaker unit described above, the leg portions may be provided by four; of the four leg portions, each two leg portions may be provided so as to be located in opposing corners, respectively; and sizes of the irregularity portions formed in each two leg portions in the opposing corners may be made different from each other.

Of the four leg portions, each two leg portions are provided so as to be located in opposing corners, respectively; and sizes of the irregularity portions formed in each two leg portions in the opposing corners are made different from each other, whereby with the simple construction, the resonance frequency in the leg portions of the frame is dispersed.

Seventhly, preferably, in the speaker unit described above, parts of the leg portions may be punched out in a thickness direction, thereby forming the irregularity portions integrally with the leg portions.

The parts of the leg portions are punched out in the thickness direction, thereby forming the irregularity portions integrally with the leg portions, whereby the irregularity portions are readily formed.

According to the embodiment of the present disclosure, firstly, the speaker unit includes: the magnetic circuit having the magnet and the coil; the vibrating plate adapted to be vibrated by the drive force of the magnetic circuit; and the frame having the circuit mounting portion to which the magnetic circuit is mounted, the edge mounting portion to which the edge of the vibrating plate is mounted, and the plural leg portions through which the circuit mounting portion and the edge mounting portion are coupled to each other and which are provided in the spaced relation to one another in a circumferential direction, in which the irregularity portions are provided in the plural leg portions, respectively, and the forms of the irregularity portions are made different from each other at least in two of the leg portions.

Therefore, the peak of the resonance is dispersed and thus the sound quality can be enhanced without reducing the strength of the frame.

Secondly, of the forms of the irregularity portions, the sizes are made different from each other.

Therefore, after the degree of freedom for the design of the frame has been increased, the sound quality can be enhanced.

Thirdly, of the forms of the irregularity portions, the shapes are made different from each other.

Therefore, after the degree of freedom for the design of the frame has been increased, the sound quality can be enhanced.

Fourthly, of the forms of the irregularity portions, the numbers are made different from each other.

Therefore, after the degree of freedom for the design of the frame has been increased, the sound quality can be enhanced.

Fifthly, the leg portions are provided by four; of the four leg portions, each two leg portions are provided so as to be located in the opposing corners, respectively; the numbers of irregularity portions formed in each two leg portions located in the opposing corners, respectively, are made equal to each other; and the numbers of the irregularity portions formed in each two leg portions adjacent to each other in the circumferential direction are be different from each other.

Therefore, with the simple construction, the sound quality can be enhanced.

Sixthly, the leg portions are provided by four; of the four leg portions, each two leg portions are provided so as to be located in opposing corners, respectively; and the sizes of the irregularity portions formed in each two leg portions in the opposing corners are made different from each other.

Therefore, with the simple construction, the sound quality can be enhanced.

Seventhly, the parts of the leg portions are punched out in the thickness direction, thereby forming the irregularity portions integrally with the leg portions.

Therefore, the irregularity portions can be readily formed, and the strengths of the legs can be enhanced.

DETAILED DESCRIPTION OF THE PREFERRED EMBODIMENT

Figure 1:
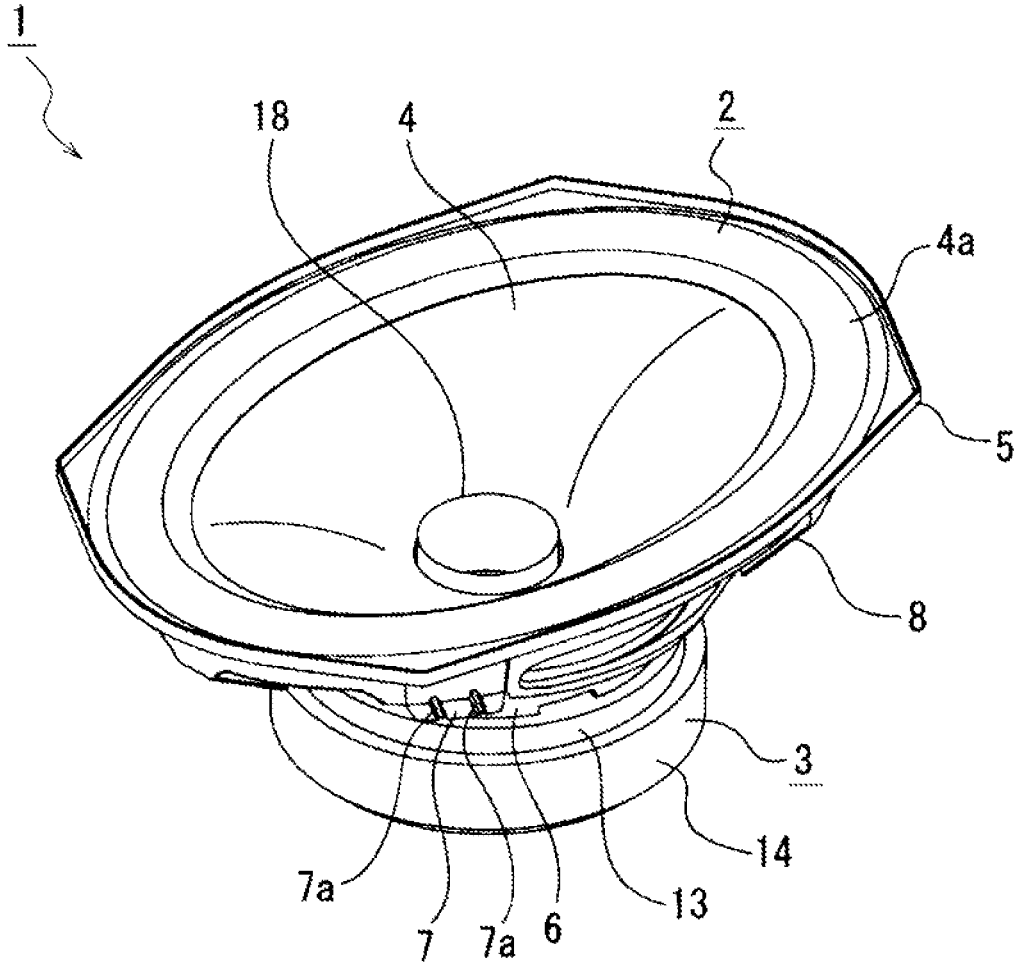
FIG. 1 is a perspective view showing a construction of a speaker unit according to an embodiment of the present disclosure.
Figure 2:
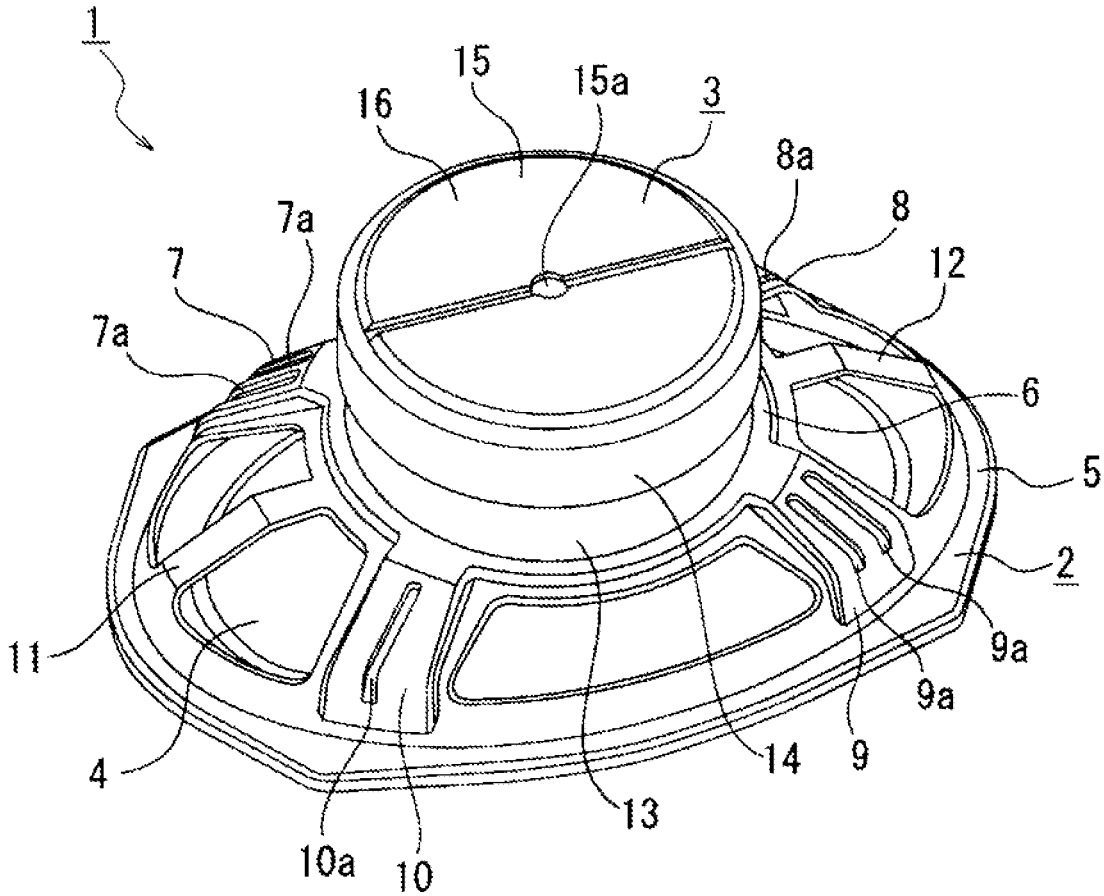
FIG. 2 is a perspective view showing a construction of the speaker unit according to the embodiment of the present disclosure when viewed from a rear surface side.
Figure 3:
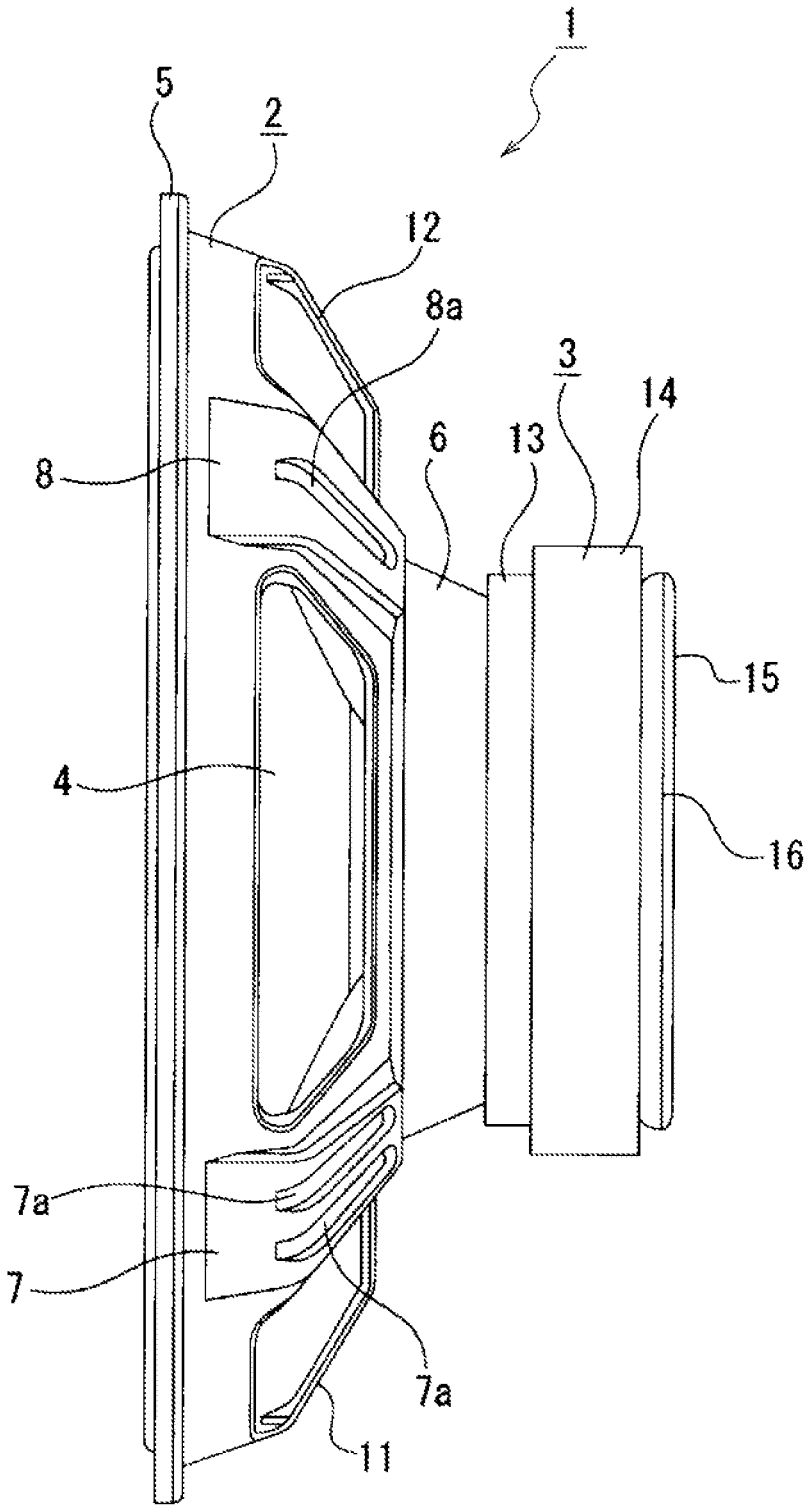
FIG. 3 is a side elevational view showing a construction of the speaker unit according to the embodiment of the present disclosure.
Figure 4:
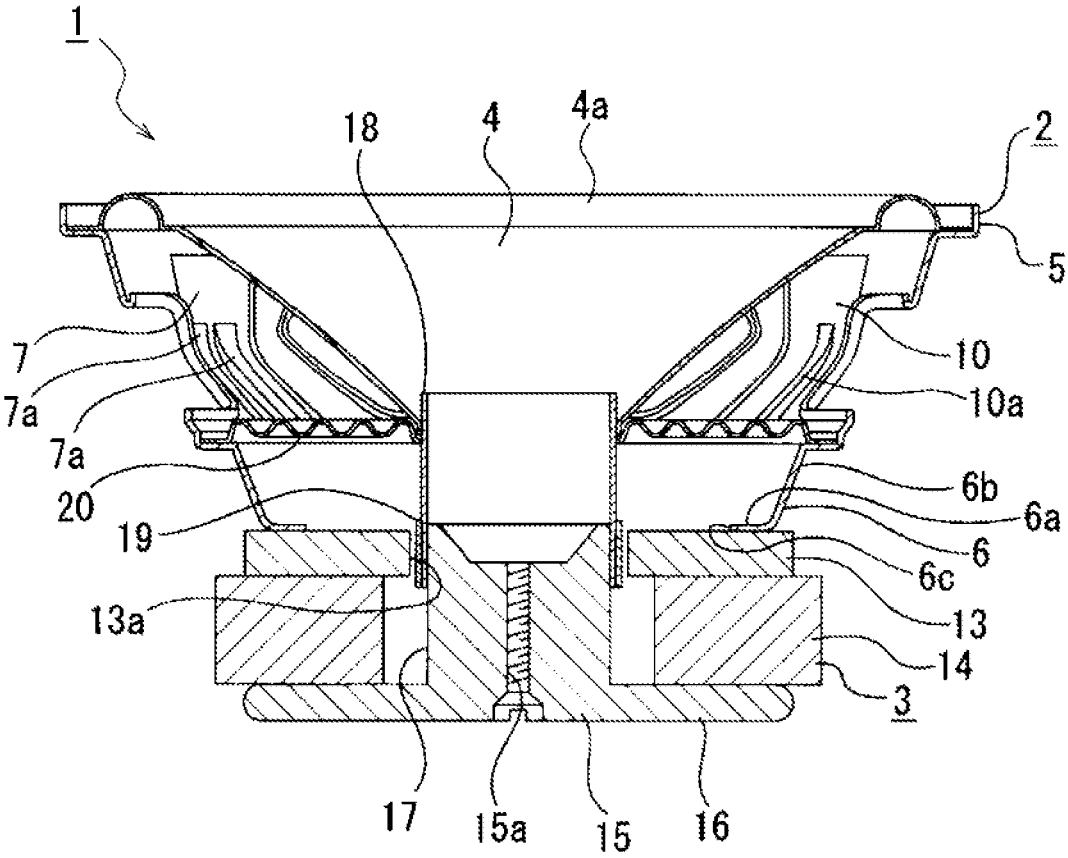
FIG. 4 is a cross sectional view showing a construction of the speaker unit according to the embodiment of the present disclosure.

An embodiment of the present disclosure will be described in detail hereinafter with reference to the accompanying drawings.

In the following description, a direction to which a speaker unit is directed is defined as a forward direction. Under this condition, vertical, front-back, and horizontal directions will be indicated below.

It should be noted that the vertical, front-back, and horizontal directions which will be indicated below are indicated for convenience of the description and thus the present disclosure is by no means applied to these directions in a limited way.

[Construction of Speaker Unit]

A speaker unit 1 includes a frame 2, a magnetic circuit 3, and a vibrating plate 4 (refer to FIGS. 1 to 4).

The frame 2 includes an edge mounting portion 5, a circuit mounting portion 6, and plural, for example, four leg portions 7, 8, 9, and 10. In this case, the edge mounting portion 5 is formed in an annular shape, for example, in a circular shape, an elliptical shape or the like. The circuit mounting portion 6 is located at the back of the edge mounting portion 5. Also, the edge mounting portion 5 and the circuit mounting portion 6 are coupled to each other through the four leg portions 7, 8, 9, and 10, and the four leg portions 7, 8, 9, and 10 are provided at equal intervals in a circumferential direction so as to be in spaced relation to one another.

The circuit mounting portion 6 has a coupling surface portion **6*a* and a circumferential surface portion 6*b*. In this case, the coupling surface portion 6*a* is formed in an annular shape directed in a front-back direction. Also, the circumferential surface portion 6*b* protrudes approximately forward from an outer peripheral portion of the coupling surface portion 6*a*. A central hole of the coupling surface portion 6*a* is formed as an insertion disposition hole 6*c***.

Figure 5:
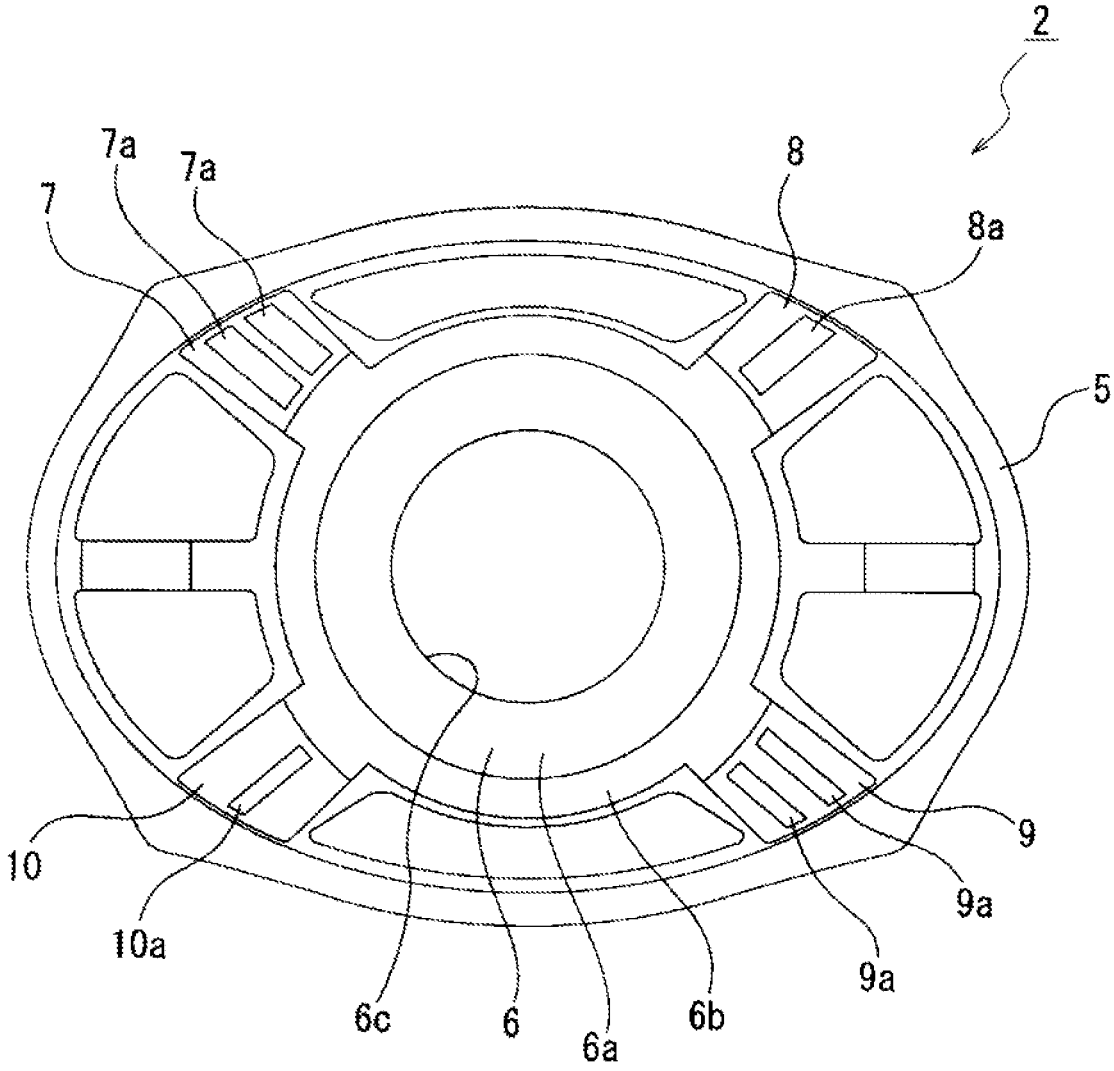
FIG. 5 is a rear elevational view showing a construction of a frame in the speaker unit according to the embodiment of the present disclosure.

The leg portions 7, 8, 9, and 10 are formed in the same outer shape and size (refer to FIG. 5), and have also the same thickness. Since the leg portions 7, 8, 9, and 10 are formed in the same outer shape and size, and have also the same thickness, the uniformity of the strength is held, and the strength of the frame 2 having the leg portions 7, 8, 9, and 10 is also held high.

The leg portions 7, 8, 9, and 10 are inclined so as to be displaced outward in upper portions thereof.

The leg portion 7 and the leg portion 9 are provided so as to be located in opposing corners, respectively, and thus are located across the center of the circuit mounting portion 6 from each other. Also, the leg portion 8 and the leg portion 10 are provided so as to be located in opposing corners, respectively, and thus are located across the center of the circuit mounting portion 6 from each other.

Irregularity portions which are different in form, that is, in size, shape or number from one another are formed in the leg portions 7, 8, 9, and 10, respectively, at least in one-to-one correspondence.

For example, the two irregularity portions 7*a*, 7*a* are formed in a circumferential direction side by side in the leg portion 7, and an irregularity portion 8*a* is formed in the leg portion 8. Also, the two irregularity portions 9*a*, 9*a* are formed in a circumferential direction side by side in the leg portion 9, and an irregularity portion 10*a* is formed in the leg portion 10. Parts of the leg portions 7, 8, 9, and 10 are punched out in a thickness direction, so that the irregularity portions 7*a*, 7*a*, 8*a*, 9*a*, 9*a*, and 10*a* are formed in a shape extending radially, for example, in a quadrangular shape such as a rectangle or a trapezoid.

The irregularity portions 7*a*, 7*a*, and 8*a* are formed approximately in the same width, and the irregularity portions 9*a*, 9*a*, and 10*a* are formed approximately in the same width. Also, each of the irregularity portions 7*a*, 7*a*, and 8*a* is wider than each of the irregularity portions 9*a*, 9*a*, and 10*a*.

In the frame 2, reinforcing coupling portions 11, 12 are provided between the leg portion 7 and the leg portion 10, and between the leg portion 8 and the leg portion 9, respectively. Thus, the edge mounting portion 5 and the circuit mounting portion 6 are coupled to each other through the reinforcing coupling portions 11, 12.

The magnetic circuit 3 is mounted to the circuit mounting portion 6 of the frame 2 (refer to FIGS. 1 to 4). The magnetic circuit 3 includes a top plate 13, a magnet 14, and a yoke 15.

The top plate 13 is made of a magnetic material so as to have an annular shape which is short in an axial direction. A central hole of the top plate 13 is formed as an insertion hole 13*a*. An axial direction of the top plate 13 is aligned with the front-back direction. Also, a front surface of the top plate 13 is mounted to a rear surface of the coupling surface portion 6*a* in the circuit mounting portion 6 of the frame 2.

The magnet 14 is formed in an annular shape which is thicker than the top plate 13. Also, an axial direction of the magnet 14 is aligned with the front-back direction, and a front surface thereof is fixed to a rear surface of the top plate 13.

The yoke 15 is made of a magnetic material. The yoke 15 is composed of a base surface portion 16 and an axis portion 17. In this case, the base surface portion 16 is formed approximately in a disc-like shape so as to be directed in the front-back direction. Also, the axis portion 17 protrudes forward from a central portion of the base surface portion 16. The yoke 15 is disposed in such a way that a front surface of the base surface portion 16 is fixed to a rear surface of the magnet 14, and the axis portion 17 is inserted into the magnet 14, an insertion hole 13*a* of the top plate 13, and an insertion disposition hole 6*c* of the circuit mounting portion 6.

A mounting hole 15*a* which completely extends through a central portion of the base surface portion 16, and a central portion of the axis portion 17 is formed in the yoke 15.

A coil bobbin 18 which is formed in a cylindrical shape is supported movably in the front-back direction by the axis portion 17 of the yoke 15. An inner peripheral portion of the vibrating plate 4 is mounted to a front end side portion of the coil bobbin 18.

A coil 19 is wound around an outer peripheral surface in the rear end portion of the coil bobbin 18. Both end portions of the coil 19 are connected to a power source circuit (not shown) through terminals (not shown) provided in the frame 2. The coil 19 is disposed in the insertion hole 13*a* of the top plate 13. When a drive current is supplied from the power source circuit to the coil bobbin 19, the coil bobbin 18 is moved in the front-back direction (minutely moved) by a thrust force generated in the magnetic circuit 3. As a result, the vibrating plate 4 is vibrated, thereby outputting a sound.

A damper 20 is mounted to a position close to the front end in the axial direction of the coil bobbin 18. The damper 20 is formed in a thin and approximately annular shape and can be elastically deformed. Also, an inner peripheral portion of the damper 20 is mounted to an outer peripheral surface of the coil bobbin 18, and an outer peripheral portion thereof is mounted to the inner surface of the frame 2. The damper 20 has a function of being elastically deformed when the drive current is supplied to the coil 19 to change the coil bobbin 18 in the axial direction, thereby suppressing an excessive change in the axial direction in the coil bobbin 18.

An outer peripheral portion of the vibrating plate 4 is provided as an edge 4*a* which is in turn mounted to the front end portion of the edge mounting portion 5 of the frame 2. Therefore, along with the axial change of the coil bobbin 18, the vibrating plate 4 is vibrated with the front end portion thereof as a fulcrum point.

The speaker unit 1, for example, is mounted to a room inside or the like of a vehicle to be used therein by screwing a screw member into the mounting hole 15*a* of the yoke 15.

Operation of Speaker Unit]

When the drive current is supplied to the coil 19 in the speaker unit 1 constructed and configured as described above, the thrust force is generated in the magnetic circuit 3 and thus the coil bobbin 18 is changed in the front-back direction (in the axial direction. As a result, the vibrating plate 4 is vibrated along with the change of the coil bobbin 18. At this time, the sound which is proportional either to the current or to the voltage is outputted.

In a phase of the change of the coil bobbin 18, the damper 20 is elastically deformed along with the change of the coil bobbin 18, thereby suppressing the excessive change in the axial direction of the coil bobbin 18.

When the vibrating plate 4 is vibrated, the frame 2 is vibrated by the reaction following the vibration of the vibrating plate 4. As a result, a peak of a resonance is generated at a specific frequency region, so that the sound pressure level is increased.

However, since in the speaker unit 1, the irregularity portions 7*a*, 7*a*, 8*a*, 9*a*, 9*a*, and 10*a* which are different in form from each other are formed in the leg portions 7, 8, 9, and 10 of the frame 2, respectively, the peak of the resonance is dispersed.

[Modified Changes of Speaker Unit]

Hereinafter, a frame 2A in a speaker unit according to a first modified change of the embodiment, a frame 2B in a speaker unit according to a second modified change of the embodiment, and a frame 2C in a speaker unit according to a third modified change of the embodiment will be described with reference to FIGS. 6 to 8, respectively.

Note that, the frames 2A, 2B, and 2C which will be shown below are each different only in form of an irregularity portion from the frame 2 described above. Therefore, only a portion(s) different from that (those) of the frame 2 will be described in detail, and other portions identical to those in the frame 2 are designated by the same reference numerals or symbols, respectively, and a description thereof is omitted here for the sake of simplicity.

Figure 6:
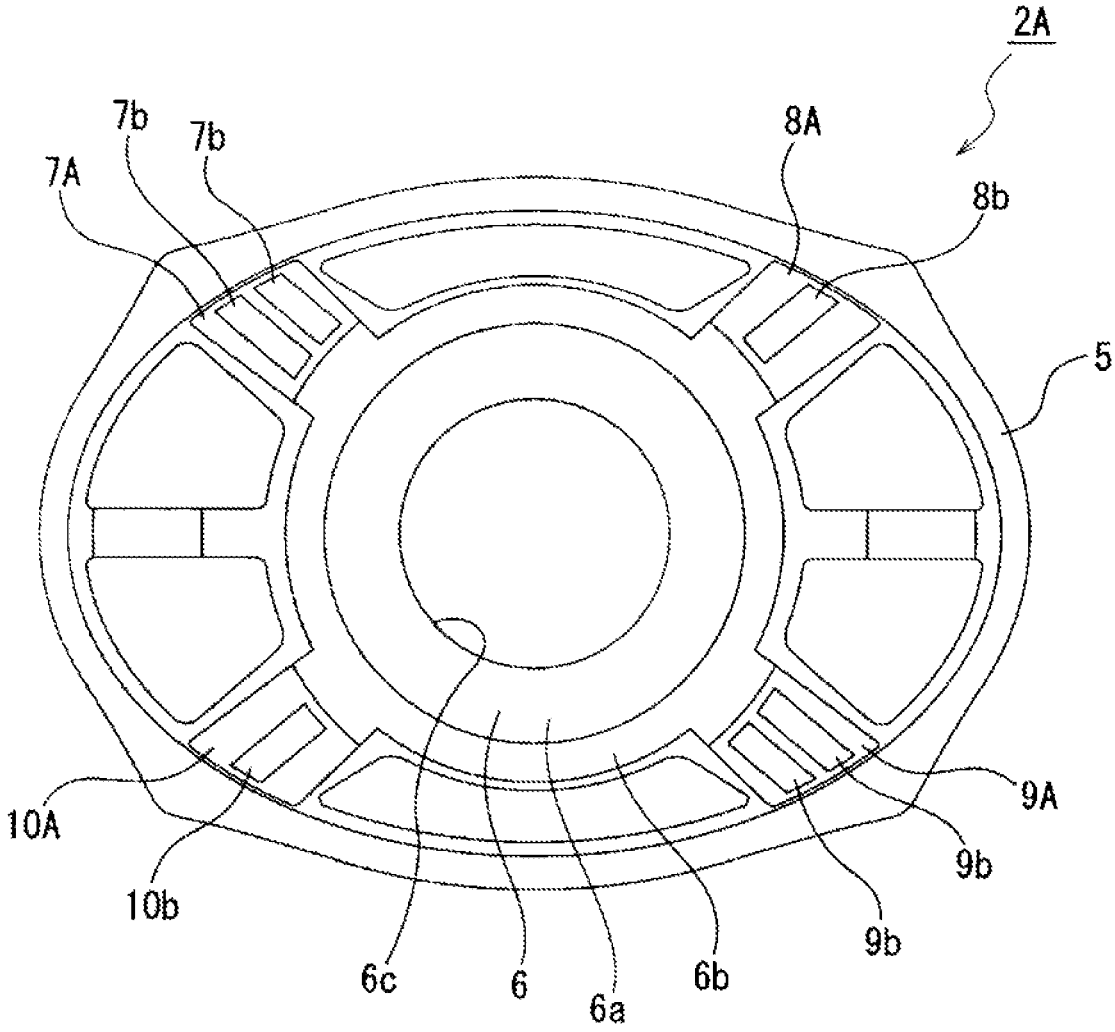
FIG. 6 is a rear elevational view showing a construction of a frame in a speaker unit according to a first modified change of the embodiment of the present disclosure.

The frame 2A in the speaker unit according to the first modified change of the first embodiment of the present disclosure includes the edge mounting portion 5, the circuit mounting portion 6, and four leg portions 7A, 8A, 9A, and 10A (refer to FIG. 6).

The four leg portions 7A, 8A, 9A, and 10A are formed in the same outer shape and size, and are also formed in the same thickness. Since the four leg portions 7A, 8A, 9A, and 10A are formed in the same outer shape and size, and are also formed in the same thickness, the uniformity of the strength is held, and the strength of the frame 2A including the four leg portions 7A, 8A, 9A, and 10A is also held high.

The leg portions 7A, 8A, 9A, and 10A are inclined so as to be displaced outward in the upper portions thereof.

The leg portion 7A and the leg portion 9A are provided so as to be located in opposing corners, respectively, and are located across the center of the circuit mounting portion 6 from each other. Also, the leg portion 8A and the leg portion 10A are provided so as to be located in opposing corners, respectively, and are located across the center of the circuit mounting portion 6 from each other.

Two irregularity portions 7*b*, 7*b* are formed in the circumferential direction side by side in the leg portion 7A, and an irregularity portion 8*b* is formed in the leg portion 8A. Two irregularity portions 9*b*, 9*b* are formed in a circumferential direction side by side in the leg portion 9A, and an irregularity portion 10*b* is formed in the leg portion 10A. Parts of the leg portions 7A, 8A, 9A, and 10A are punched out in the thickness direction, so that the irregularity portions 7*b*, 7*b*, 8*b*, 9*b*, 9*b*, and 10*b* are each formed in a shape extending radially, for example, in a quadrangular shape such as a rectangle or a trapezoid.

The irregularity portions 7*b*, 7*b*, 8*b*, 9*b*, 9*b*, and 10*b* are formed approximately in the same width.

Figure 7:
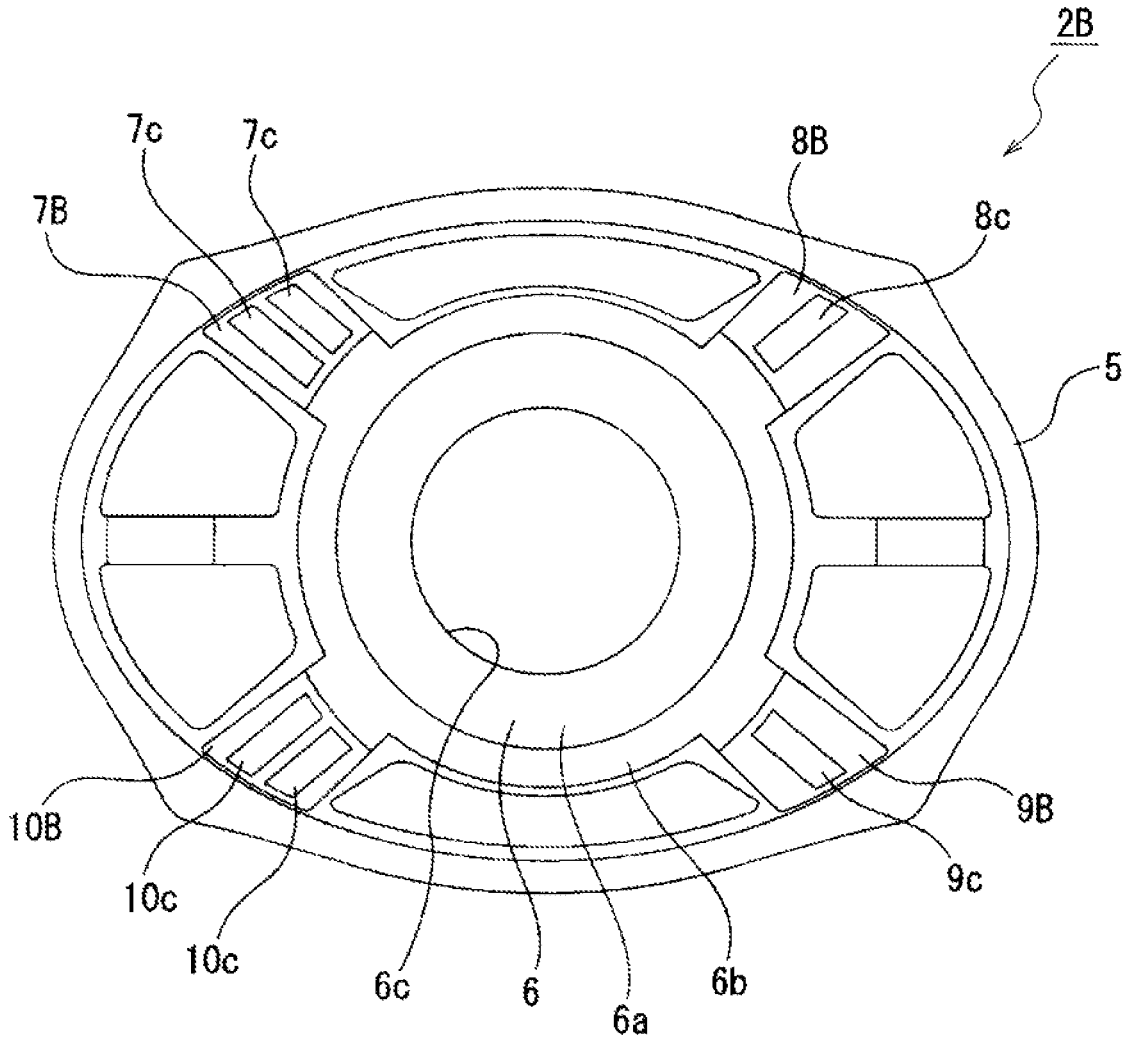
FIG. 7 is a rear elevational view showing a construction of a frame in a speaker unit according to a second modified change of the embodiment of the present disclosure.

The frame 2B in the speaker unit according to the second modified change of the first embodiment of the present disclosure includes the edge mounting portion 5, the circuit mounting portion 6, and four leg portions 7B, 8B, 9B, and 10B (refer to FIG. 7).

The four leg portions 7B, 8B, 9B, and 10B are formed in the same outer shape and size, and are also formed in the same thickness. Since the four leg portions 7B, 8B, 9B, and 10B are formed in the same outer shape and size, and are also formed in the same thickness, the uniformity of the strength is held, and the strength of the frame 2B including the four leg portions 7B, 8B, 9B, and 10B is also held high.

The leg portions 7B, 8B, 9B, and 10B are inclined so as to be displaced outward in the upper portions thereof.

The leg portion 7B and the leg portion 9B are provided so as to be located in opposing corners, respectively, and are located across the center of the circuit mounting portion 6 from each other. Also, the leg portion 8B and the leg portion 10B are provided so as to be located in opposing corners, respectively, and are located across the center of the circuit mounting portion 6 from each other.

Two irregularity portions 7*c*, 7*c* are formed in the circumferential direction side by side in the leg portion 7B, and an irregularity portion 8*c* is formed in the leg portion 8B. Also, one irregularity portion 9*c* is formed in the leg portion 9B, and two irregularity portions 10*c*, 10*c* are formed in a circumferential direction side by side in the leg portion 10B. Parts of the leg portions 7B, 8B, 9B, and 10B are punched out in the thickness direction, so that the irregularity portions 7*c*, 7*c*, 8*c*, 9*c*, 10*c*, and 10*c* are each formed in a shape extending radially, for example, in a quadrangular shape such as a rectangle or a trapezoid.

The irregularity portions 7*c*, 7*c*, 8*c*, 9*c*, 10*c*, and 10*c* are formed approximately in the same width.

Figure 8:
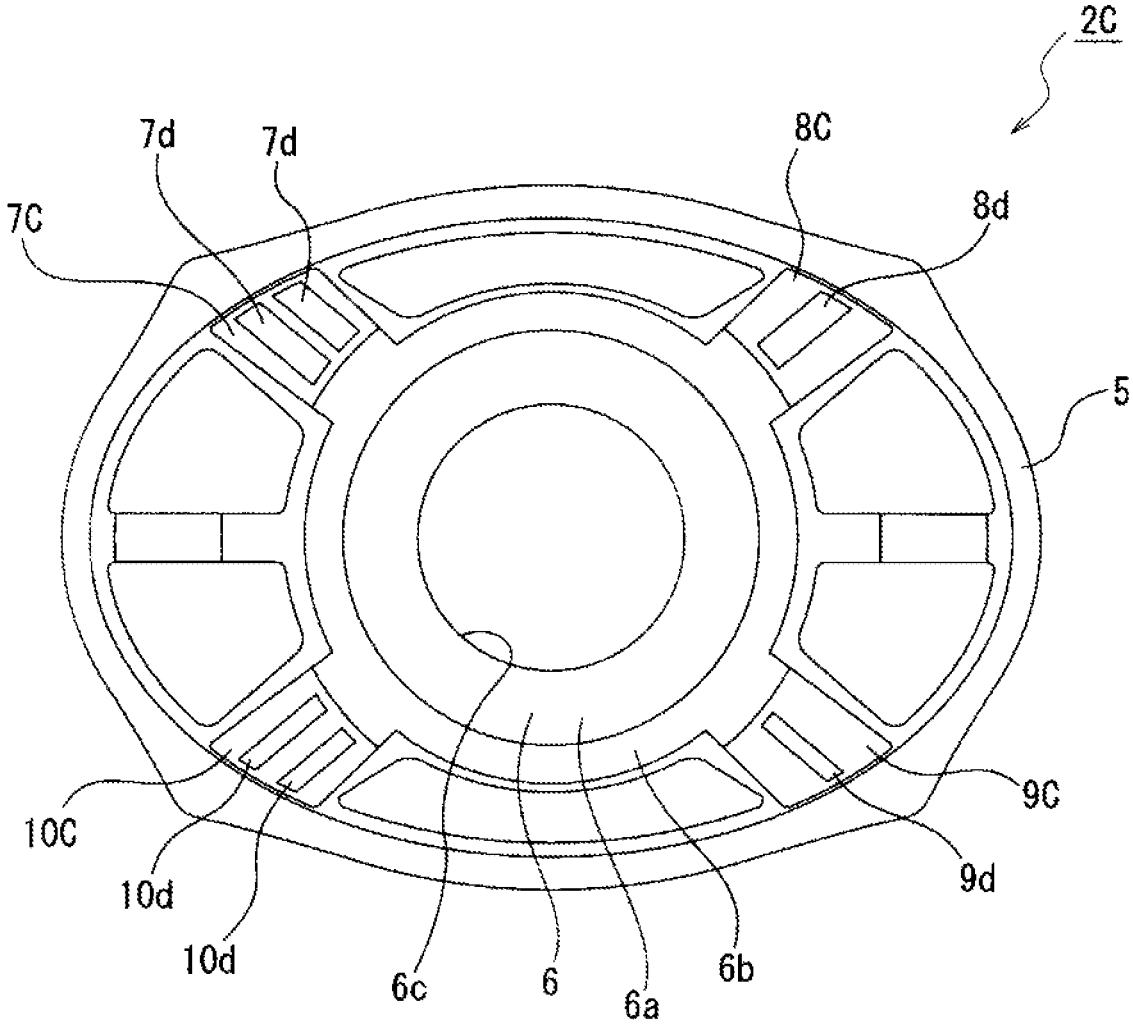
FIG. 8 is a rear elevational view showing a construction of a frame in a speaker unit according to a third modified change of the embodiment of the present disclosure.

The frame 2C in the speaker unit according to the third modified change of the first embodiment of the present disclosure includes the edge mounting portion 5, the circuit mounting portion 6, and four leg portions 7C, 8C, 9C, and 10C (refer to FIG. 8).

The four leg portions 7C, 8C, 9C, and 10C are formed in the same outer shape and size, and are also formed in the same thickness. Since the four leg portions 7C, 8C, 9C, and 10C are formed in the same outer shape and size, and are also formed in the same thickness, the uniformity of the strength is held, and the strength of the frame 2C including the four leg portions 7C, 8C, 9C, and 10C is also held high.

The leg portions 7C, 8C, 9C, and 10C are inclined so as to be displaced outward in the upper portions thereof.

The leg portion 7C and the leg portion 9C are provided so as to be located in opposing corners, respectively, and are located across the center of the circuit mounting portion 6 from each other. Also, the leg portion 8C and the leg portion 10C are provided so as to be located in opposing corners, respectively, and are located across the center of the circuit mounting portion 6 from each other.

Two irregularity portions 7*d*, 7*d* are formed in the circumferential direction side by side in the leg portion 7C, and an irregularity portion 8*d* is formed in the leg portion 8C. Also, one irregularity portion 9*d* is formed in the leg portion 9C, and two irregularity portions 10*d*, 10*d* are formed in a circumferential direction side by side in the leg portion 10C. Parts of the leg portions 7*c*, 8*c*, 9*c*, and 10*c* are punched out in the thickness direction, so that the irregularity portions 7*d*, 7*d*, 8*d*, 9*d*, 10*d*, and 10*d* are formed in a shape extending radially, for example, in a quadrangular shape such as a rectangle or a trapezoid.

The irregularity portions 7*d*, 7*d*, and 8*d* are formed approximately in the same width, and the irregularity portions 9*d*, 10*d*, and 10*d* are formed approximately in the same width. Also, each of the irregularity portions 7*d*, 7*d*, and 8*d* is formed so as to be wider than that of each of the irregularity portions 9*d*, 10*d*, and 10*d*.

[Others Modified Changes]

Although in the embodiment and the first to third modified changes thereof, there is shown the case where each of the irregularity portions is formed in the quadrangular shape, the shape of each of the irregularity portions is by no means limited to the quadrangular shape, and thus can be formed in an arbitrary shape.

Figure 9:
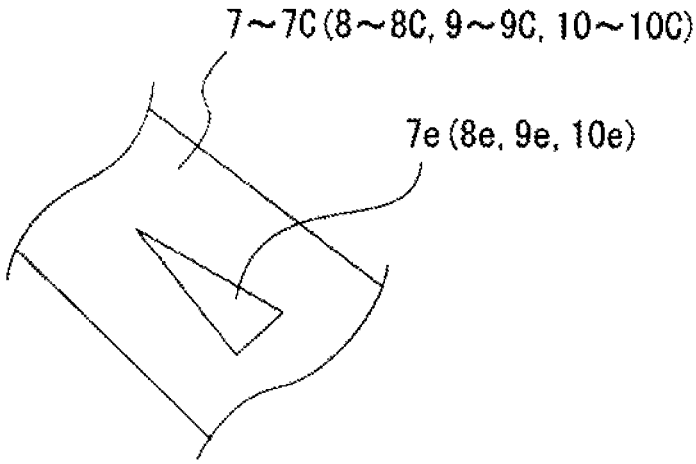
FIG. 9 is a conceptual view showing a construction of an example of an irregularity portion in the speaker unit of the embodiment.
Figure 10:
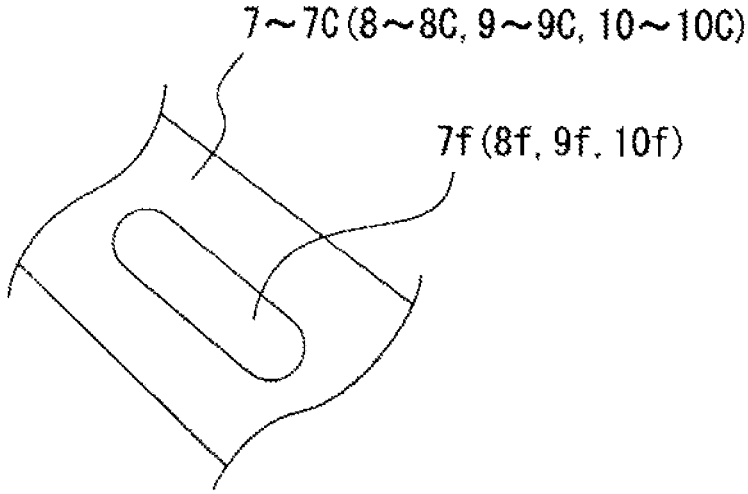
FIG. 10 is a conceptual view showing a construction of another example of an irregularity portion in the speaker unit of the embodiment.
Figure 11:
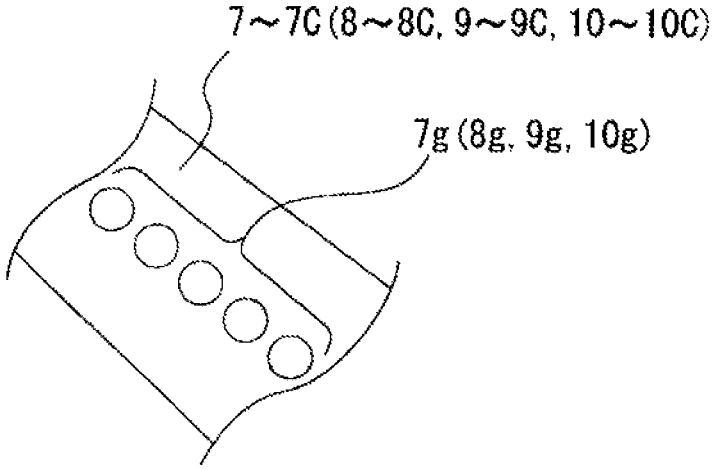
FIG. 11 is a conceptual view showing a construction of still another example of an irregularity portion in the speaker unit of the embodiment.

For example, as shown in FIG. 9, a triangle-shaped irregularity portion 7*e* (8*e*, 9*e*, and 10*e*) may also be adopted, or as shown in FIG. 10, an oval-shaped irregularity portion 7*f* (8*f*, 9*f*, and 10*f*) may also be adopted. In addition thereto, as shown in FIG. 11, an irregularity portion 7*g* (8*g*, 9*g*, and 10*g*) in which plural portions are formed in line may also be adopted.

[Measured Data]

Hereinafter, a description will be given with respect to measured data, on a relationship between a frequency and a sound pressure, which was obtained from the speaker unit 1 including the frame 2 having the irregularity portions 7*a*, 7*a*, 8*a*, 9*a*, 9*a*, and 10*a* formed therein, and the speaker unit 1 including the frame 2A having the irregularity portions 7*b*, 7*b*, 8*b*, 9*b*, 9*b*, and 10*b* formed therein as compared with the case of the existing speaker unit having no irregularity portion formed therein with reference to FIGS. 12 and 13.

Figure 12:
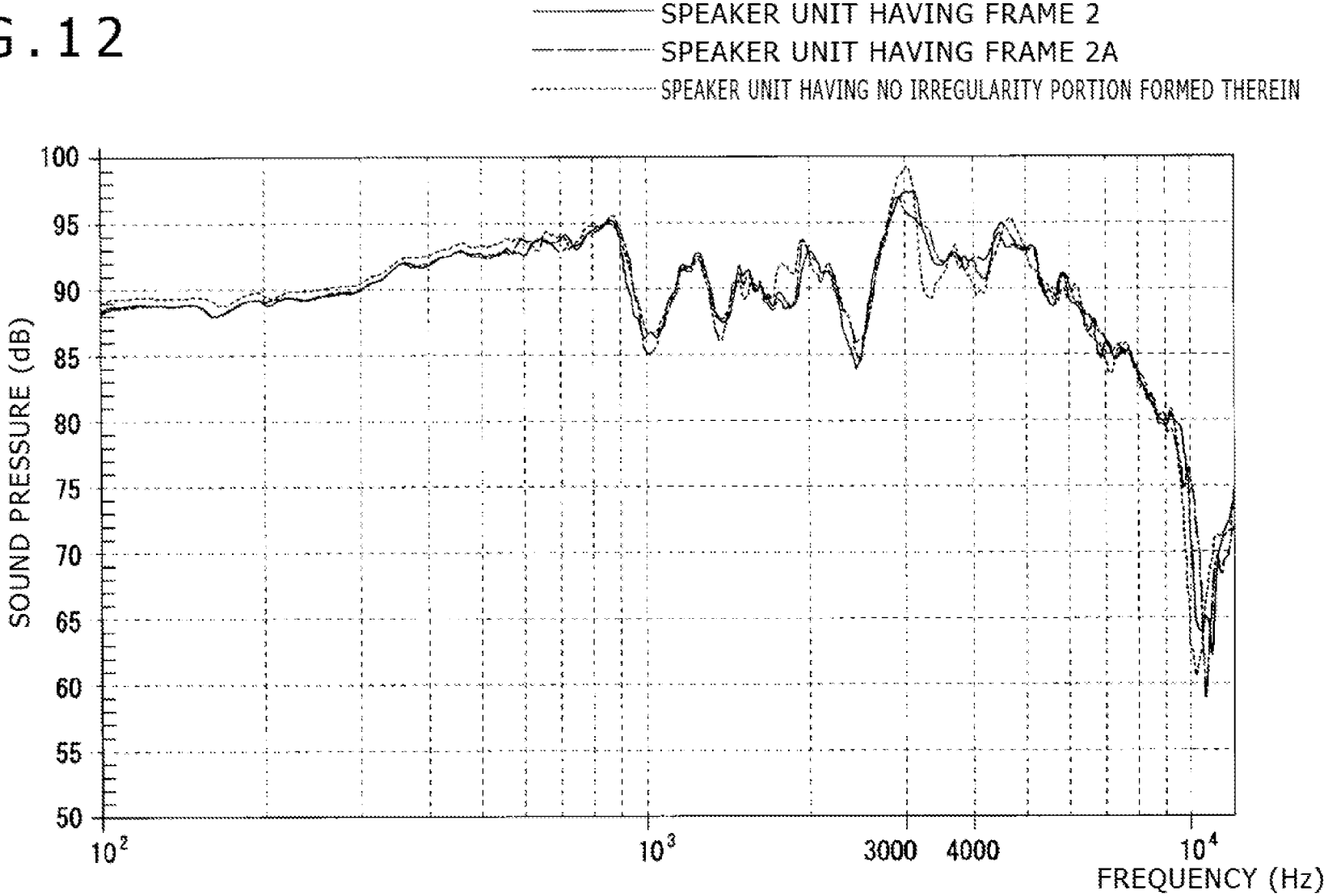
FIG. 12 is a graph representing measured data on a frequency and a sound pressure.

FIG. 12 is a graph representing the relationship between the frequency and the sound pressure. In the figure, an axis of abscissa represents the frequency, and an axis of ordinate represents the sound pressure. In addition, FIG. 13 is a graph representing the measured data which is shown by enlarging a part of the graph of FIG. 12 in the vicinities of 3,000 to 4,000 Hz.

Figure 13:
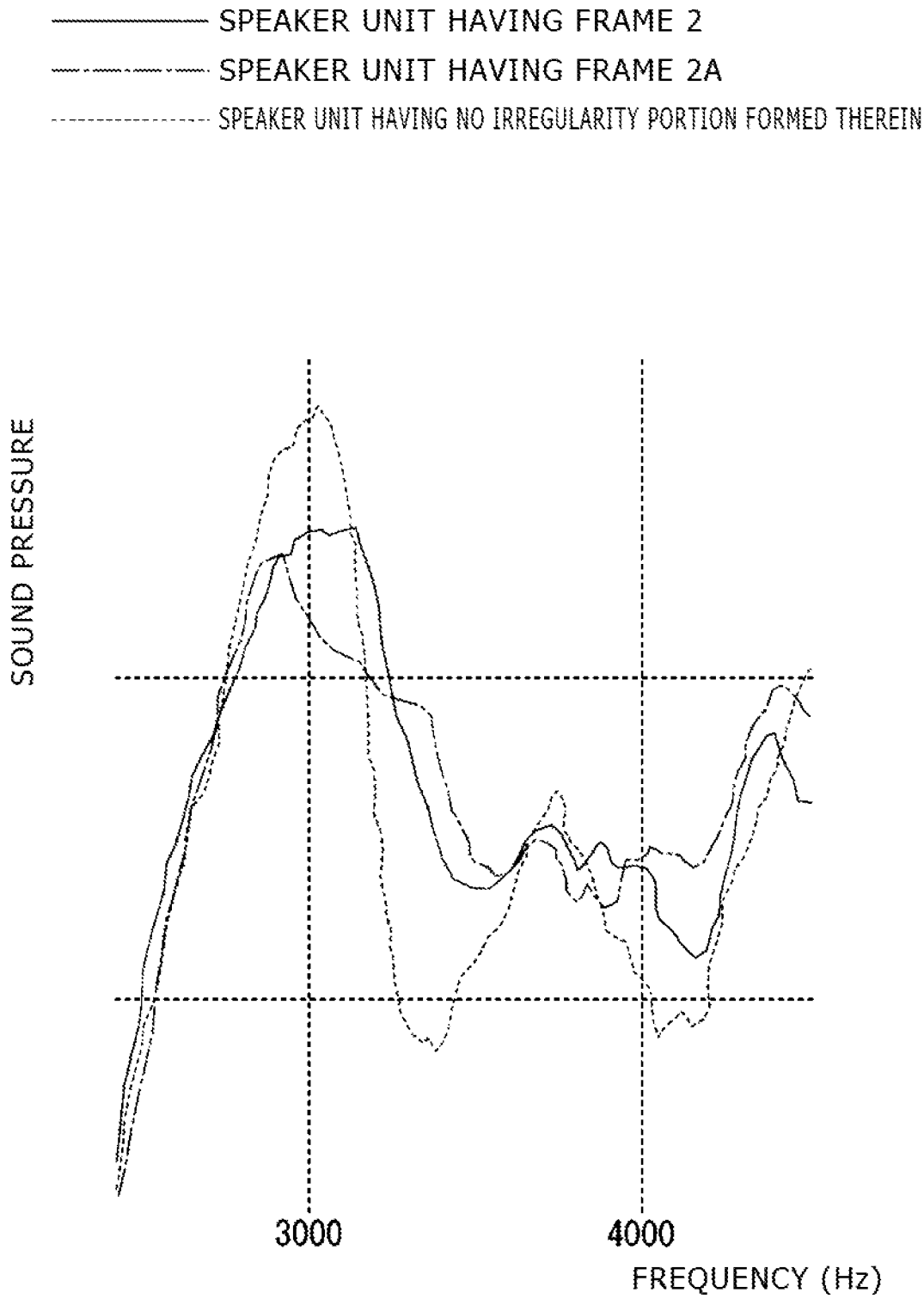
FIG. 13 is a graph representing the measured data which is shown by enlarging a part of the graph shown in FIG. 12.

In FIGS. 12 and 13, a solid line indicates the measured data obtained from the speaker unit 1 including the frame 2, a dashed line indicates the measured data obtained from the speaker unit 1 including the frame 2A, and a dotted line indicates the measured data obtained from the existing speaker unit having no irregularity portion formed therein.

As shown in FIGS. 12 and 13, it is understood that the peak (dip) of the resonance is lower in each of the speaker unit 1 including the frame 2 and the speaker unit 1 including the frame 2A than in the existing speaker unit having no irregularity portion formed therein, and thus the sound quality is enhanced in each of the speaker unit 1 including the frame 2 and the speaker unit 1 including the frame 2A.

[Conclusions]

As has been described so far, in the speaker unit 1, the irregularity portions 7*a*, 8*a*, 9*a*, and 10*a* (including 7*b* to 10*b*, 7*c* to 10*c*, and 7*d* to 10*d*, as the case may be) are formed in the plural leg portions 7, 8, 9, and 10 (including 7A to 10A, 7B to 10B, and 7C to 10C, as the case may be), respectively. Also, the forms of the irregularity portions 7*a*, 8*a*, 9*a*, and 10*a* are made different from each other at least in the two leg portions 7, 8, 9, and 10.

Therefore, the sound quality can be enhanced without causing the reduction of the strength of the frame 2 (including 2A to 2C, as the case may be).

In addition, of the forms of the irregularity portions 7*a* and the like, the sizes, shapes, numbers or combinations thereof are made different from each other, whereby after the degree of freedom for the design of the frame 2 has been increased, the sound quality can be enhanced.

Moreover, like the frame 2 or the like, the four leg portions 7, 8, 9, and 10 are provided, and the numbers of irregularity portions 7*a*, 7*a*, 9*a*, and 9*a* formed in the leg portions 7 and 9 located in the opposing corners are made equal to each other, and the numbers of irregularity portion 8*a* and 10*a* formed in the leg portions 8 and 10 located in the opposing corners are made equal to each other. Also, the numbers of irregularity portions 7*a* and the like formed in the leg portions 7, 8, 9, and 10 adjacent to each other in the circumferential direction are also made different from each other. As a result, with the simple construction, the sound quality can be enhanced.

Furthermore, the leg portions 7 and 9 are provided so as to be located in the opposing corners, respectively, and the leg portions 8 and 10 are provided so as to be located in the opposing corners, respectively. In this case, the size of the irregularity portions 7*a*, 7*a*, 9*a*, and 9*a* formed in the leg portions 7 and 9 located in the opposing corners, respectively, and the size of the irregularity portions 8*a* and 10*a* formed in the leg portions 8 and 10 located in the opposing corners, respectively, are made different from each other. As a result, with the simple construction, the sound quality can be enhanced.

In addition thereto, the irregularity portions 7*a* and the like are formed integrally with the leg portion 7 and the like by punching out the parts of the irregularity portions 7*a* and the like in the thickness direction. Therefore, the irregularity portions 7*a* and the like can be readily formed, and the strengths of the leg portion 7 and the like can be increased.

It is noted that although in general, the steel plate is subjected to the press molding to be processed into the frame of the speaker unit, according to the construction described above, the resonance frequency is dispersed while the strength is maintained only through the process of the pressing molding, thereby making it possible to enhance the sound quality.

[Technique of the Present Disclosure]

The technique of the present disclosure can adopt the following constitutions.

(1) A speaker unit including: a magnetic circuit having a magnet and a coil; a vibrating plate adapted to be vibrated by a drive force of the magnetic circuit; and a frame having a circuit mounting portion to which the magnetic circuit is mounted, an edge mounting portion to which an edge of the vibrating plate is mounted, and plural leg portions through which the circuit mounting portion and the edge mounting portion are coupled to each other and which are provided in spaced relation to one another in a circumferential direction, in which irregularity portions are provided in the plural leg portions, respectively, and forms of the irregularity portions are made different from each other at least in two of the leg portions.

(2) The speaker unit described in the paragraph (1), in which of the forms of the irregularity portions, sizes are made different from each other.

(3) The speaker unit described in the paragraph (1) or (2), in which of the forms of the irregularity portions, shapes are made different from each other.

(4) The speaker unit described in any one of the paragraphs (1) to (3), in which of the forms of the irregularity portions, numbers are made different from each other.

(5) The speaker unit described in any one of the paragraphs (1) to (4), in which the leg portions are provided by four; of the four leg portions, each two leg portions are provided so as to be located in the opposing corners, respectively; the numbers of irregularity portions formed in each two leg portions located in the opposing corners, respectively, are made equal to each other; and the numbers of irregularity portions formed in each two leg portions adjacent to each other in the circumferential direction are made different from each other.

(6) The speaker unit described in any one of the paragraphs (1) to (5), in which the leg portions are provided by four; of the four leg portions, each two leg portions are provided so as to be located in opposing corners, respectively; and sizes of the irregularity portions formed in each two leg portions in the opposing corners are made different from each other.

(7) The speaker unit described in any one of the paragraphs (1) to (6), in which parts of the leg portions are punched out in the thickness direction, thereby forming the irregularity portions integrally with the leg portions.

It should be understood by those skilled in the art that various modifications, combinations, sub-combinations and alterations may occur depending on design requirements and other factors in so far as they are within the scope of the appended claims or the equivalents thereof.

The present disclosure contains subject matter related to that disclosed in Japanese Priority Patent Application JP 2011-289032 filed in the Japan Patent Office on Dec. 28, 2011, the entire content of which is hereby incorporated by reference.

What is claimed is:

1. A speaker unit, comprising:

a magnetic circuit having a magnet and a coil;

a vibrating plate adapted to be vibrated by a drive force of said magnetic circuit; and a frame having a circuit mounting portion to which said magnetic circuit is mounted, an edge mounting portion to which an edge of said vibrating plate is mounted, and plural leg portions through which said circuit mounting portion and said edge mounting portion are coupled to each other and which are provided in spaced relation to one another in a circumferential direction, wherein irregularity portions are provided in said plural leg portions, respectively, and forms of said irregularity portions are made different from each other at least in two of said leg portions.

2. The speaker unit according to claim 1, wherein of the forms of said irregularity portions, sizes are made different from each other.

3. The speaker unit according to claim 1, wherein of the forms of said irregularity portions, shapes are made different from each other.

4. The speaker unit according to claim 1, wherein of the forms of said irregularity portions, numbers are made different from each other.

5. The speaker unit according to claim 1, wherein said leg portions are provided by four;

of said four leg portions, each two leg portions are provided so as to be located in the opposing corners, respectively;

the numbers of irregularity portions formed in each two leg portions located in the opposing corners, respectively, are made equal to each other; and the numbers of irregularity portions formed in each two leg portions adjacent to each other in the circumferential direction are made different from each other.

6. The speaker unit according to claim 1, wherein said leg portions are provided by four;

of said four leg portions, each two leg portions are provided so as to be located in opposing corners, respectively; and sizes of said irregularity portions formed in each two leg portions in the opposing corners are made different from each other.

7. The speaker unit according to claim 1, wherein parts of said leg portions are punched out in the thickness direction, thereby forming said irregularity portions integrally with said leg portions.

* * * * *